US006555512B1

(12) United States Patent
Coggeshall et al.

(10) Patent No.: US 6,555,512 B1
(45) Date of Patent: Apr. 29, 2003

(54) PEROXIDE CONTAINING LIQUID LAUNDRY FORMULATION

(75) Inventors: Ryan Coggeshall, Hamilton, OH (US); Bryon Ohmart, Cincinnati, OH (US); Andrew Weber, Mason, OH (US)

(73) Assignee: Washing Systems, Inc., Cincinnati, OH (US)

( * ) Notice: Subject to any disclaimer, the term of this patent is extended or adjusted under 35 U.S.C. 154(b) by 45 days.

(21) Appl. No.: 09/954,826

(22) Filed: Sep. 18, 2001

(51) Int. Cl.[7] ..... C11D 3/395
(52) U.S. Cl. ..... 510/340; 510/375
(58) Field of Search ..... 510/370, 405, 510/375, 461, 337, 340, 303

(56) References Cited

U.S. PATENT DOCUMENTS 4,169,817 A 10/1979 Weber
4,496,473 A 1/1985 Sanderson
4,525,291 A 6/1985 Smith et al.
4,865,758 A 9/1989 Caster et al.
4,904,408 A 2/1990 Kud et al.
4,981,606 A 1/1991 Barnes
5,264,158 A 11/1993 Stern
5,607,618 A 3/1997 Antwerpen et al.
5,643,861 A 7/1997 de Guertechin et al.
5,670,469 A 9/1997 Dingus et al.
5,928,435 A 7/1999 Berger

*Primary Examiner*—Yogendra N. Gupta
*Assistant Examiner*—John M Petruncio
(74) *Attorney, Agent, or Firm*—Wood, Herron & Evans, LLP

(57) ABSTRACT

A detergent composition which is liquid at application temperature includes a hydrophobic surfactant system in combination with an aqueous component which is maintained in solution without gellation by an effective amount of N-methyl pyrrolidone. The N-methyl pyrrolidone allows the aqueous component preferably an aqueous solution of hydrogen peroxide to mix with the surfactant blend without causing the surfactant blend to gel. The N-methyl pyrrolidone can also be used to achieve similar results with other aqueous detergent components.

12 Claims, No Drawings

PEROXIDE CONTAINING LIQUID LAUNDRY FORMULATION

BACKGROUND

Initially, detergents used in industrial laundries were formulations of dry products or powders. The industry trend (over the past five years) has been moving toward formulated liquid products since these offer handling advantages versus dry products. Liquid detergents can be automatically dosed to washing machines using pumping equipment which reduces potential errors in dispensing, reduces labor, and allows automatic tracking of chemical usage.

Liquid detergents are primarily liquid surfactant blends. The primary function of surfactant is to wet surfaces and emulsify soils. These detergents can incorporate other components such as degreasers, brighteners, viscosity modifiers, dyes, and the like. Alkaline builders, sequestering agents, bleaches and finishing chemicals such as starches, softeners, and sours can be added separately. One particularly useful bleach is hydrogen peroxide. Compared to chlorine bleach, it is more suitable for the environment since it decomposes into water and oxygen.

Hydrogen peroxide is typically available in an aqueous solution. When the surfactant system contains a significant amount of hydrophobic surfactant (i.e., has a hydrophilic-lipophilic balance (HLB) of less than about 11–12), the addition of aqueous components causes the surfactant blend to approach the gel phase which increases viscosity. This interferes with the detergent feed system causing delivery errors and increased delivery times. Gels also require longer dissolution times once inside the washer. Viscosity may be modified by adding various hydrotropes. However, solvated hydrotopes tend to lower the flashpoint of the detergent.

Accordingly, it is an object of the present invention to incorporate aqueous components into a liquid laundry detergent having a surfactant system which would normally not accept aqueous components and preferably to incorporate an aqueous solution of hydrogen peroxide into such a surfactant system. This is accomplished by adding to the surfactant system N-methyl pyrrolidone (NMP) in an amount effective to permit addition of at least about 15% by weight of an aqueous component and again preferably an aqueous solution of hydrogen peroxide. Generally the detergent system will contain a water-insoluble surfactant and have an HLB of 9 to about 12.

The objects and advantages of the present invention will be further appreciated in light of the following detailed description.

DETAILED DESCRIPTION

The detergent formulation of the present invention includes a liquid surfactant system containing at least one surfactant that is insoluble in water (i.e., low HLB), -methyl pyrrolidone and an aqueous component. The HLB of the surfactant system is such that it will not readily accept a significant amount of aqueous component without gellation or separation. Generally the HLB of the detergent will be 10 to about 12, preferably 10 to 11.5.

The surfactant system can be selected from a wide variety of liquid surfactants. Primarily these will be nonionic surfactants. Suitable surfactants include the linear alcohol ethoxylates, alkylphenol ethoxylates, ethoxylated amines, ethoxylated mercaptons, EO/PO block copolymers, the secondary alcohol ethoxlates, and basically any other surfactant generally suited for laundry purposes wherein the surfactant is liquid in a temperature range of about 10° F. or higher. Preferred linear alcohol ethoxylates include $C_9$–$C_{16}$ alkyls with 3–9 moles ethylene oxide (EO). Preferred alkyl phenol ethoxylates include octyl and nonyl phenols with 4–13 moles EO.

In addition to these nonionic surfactants, amphoterics and in particular the betaines can be used. Further, anionic surfactants such as linear alkyl sulfonates and alkyl benzene sulfonates can be combined with the nonionic surfactants. However, these cannot form the sole basis of the surfactant system because their inherent high solubility in water renders them less effective at cleaning versus a nonionic surfactant blend containing low soluble components.

The system will further include an aqueous component. The preferred aqueous component is an aqueous solution of hydrogen peroxide which can be obtained in a wide variety of concentrations. A 35% solution of hydrogen peroxide is commercially available and effective.

Other aqueous components which can be added to the detergent include for example aqueous solutions of inorganic salts, including surfactants, water soluble polymers such as acrylates and methacrylates, aqueous chelating agents such as metal poly and pyrophosphates, EDTA, NTA, triethanolamine, sodium citrate, aqueous solutions of metal percarbonates, metal perborates, metal peroxides, and peroxy acids such as peracetic acid.

The detergent composition will also include N-methyl pyrrolidone (NMP) in an amount effective to prevent gellation of the surfactant system with the concentration of water present.

Generally it is preferred for the surfactant system to be from about 20% to about 80% by weight of nonionic surfactant with about 30% to 40% preferred and 38% most preferred. For low temperature detergent formulations, higher surfactant concentrations are preferred, preferably about 70%. The concentration of N-methyl pyrrolidone can then be from about 3% to about 10% of the detergent composition with the preferred amount of about 6% by weight. Generally sufficient N-methyl pyrrolidone is added to keep the viscosity less than about 300 cP @ 70° F. A lower HLB of the surfactant blend will require more NMP as will a higher water content.

The remainder will be one or more aqueous component with the aqueous component being from about 15% to about 77% of the total detergent composition by weight. Thus, a 35% solution of hydrogen peroxide provides from about 5% to about 30% as active hydrogen peroxide.

In certain applications it may be desirable to add a degreasing agent such as an aromatic hydrocarbon. Other such degreasing agents such as kerosene-based hydrocarbons can also be employed. Aromatic hydrocarbons and other non-polar organic solvents are not miscible with the aqueous peroxide component and also require enough (i.e., 1–5% by weight) of a suitable hydrotrope (i.e., NMP) to prevent gellation.

Generally the organic degreaser should be from about 0% to about 6% with about 4% preferred. In addition to this a ($C_1$–$C_8$)alkyl ether of alkylene($C_2$–$C_3$)glycol can be added. Ethylene glycol monobutyl ether is one preferred additive. These improve detergency and also reduce the gellation temperature of the components.

In general the surfactant system will be a blend of surfactants which will preferably have an HLB of about 10.5–11.4. A number of different surfactants are blended to achieve the desired HLB. Preferred surfactant blends include a combination of nonyl phenol ethoxylates containing 4, 6 and 9 moles EO. The particular surfactant blend is a matter of choice and there is a wide variety of surfactants and combinations that can be employed to achieve an effective liquid surfactant blend for the desired application temperature.

To formulate the detergent composition, all liquid surfactants are mixed with the N-methyl pyrrolidone as well as any other organic components such as the organic solvent. After this is adequately mixed, generally 1–5 minutes, the aqueous component(s) is added. Mixing is continued for a brief period of time, 5–10 minutes. Heat of solution is generated when a peroxide solution is added to the other components. Therefore, a cool down time may be necessary before shipping. The final blend should be clear and one continuous phase with low viscosity.

In use, the detergent concentration will be about 0.01–0.75%. It will be used at a temperature of 80° F. to 180° F. and at a pH of 7–12 depending on the articles being laundered. Also, it can be used in combination with alkaline builders and sequestering agents which are added separately.

The following formulations were produced according to this method to formulate various detergent formulations which were subsequently tested for viscosity as well as temperature stability.

FORMULATIONS

| No Trade Names | 1 | 2 | 3 | 4 | 5 | 6 | 7 |
|---|---|---|---|---|---|---|---|
| Surfonic N95 | 23.24 | 23.24 | 23.24 | 23.24 | 51 | 48 | 45 |
| Surfonic N40 | 15.45 | 15.45 | 15.45 | 15.45 | 34 | 32 | 30 |
| N-methyl pyrrolidone | 3.89 | 7.78 | 11.67 | 0 | 0 | 0 | 0 |
| Hydrogen peroxide, 35% | 57.42 | 53.53 | 49.64 | 61.31 | 15 | 20 | 25 |

All formulations were stored in a freezer overnight and then thawed. Formulation #1 was hazy but returned to clear upon mixing. Formulations #2 and #3 remained clear the entire time. Viscosity was measured after 24 hr.

| | 1 | 2 | 3 | 4 | 5 | 6 | 7 |
|---|---|---|---|---|---|---|---|
| Viscosity @ 66° F. | 408 cP | 307 cP | 225 cP | GEL | 620 cP | Hazy thick gel | GEL |

Next the formulations were stored uncovered at room temperature for 4 days after which time viscosity was measured again. Product temperature was 71 F. All products were clear.

| | 1 | 2 | 3 |
|---|---|---|---|
| GEL Viscosity @ 4 days | 323 cP | 253 cP | 192 cP |

A four gallon sample of Formulation #2 was mixed and stored in a refrigerator for 3 days.

Initial Properties pH of 1% solution=5.7

Density=1.08 (g/ml)

Oxygen content=24%

After 3 days the detergent was removed from the refrigerator. The product appeared clear and consistent with no change in initial properties.

This demonstrates that the N-methyl pyrrolidone is effective as low as slightly less than 4% to permit addition of 57% of an aqueous solution of 35% hydrogen peroxide to the surfactant blend. The viscosity dramatically improved when approximately 12% of the N-methyl pyrrolidone was added especially at temperatures below freezing. This also demonstrates that without N-methylpyrrolidone, only 15% hydrogen peroxide solution can be incorporated into the formulation. N-methylpyrrolidone allows higher amounts of hydrogen peroxide and improves viscosity at lower temperatures.

The following is an example of a low temperature detergent formulation:

Low Temp Detergent

| Raw material in order of addition | % of formula |
|---|---|
| Surfonic N60 | 55.0 |
| Surfonic N40 | 9.0 |
| Surfonic N95 | 6.0 |
| N-methyl pyrrolidone (NMP) | 3.5 |
| Aromatic 100 | 4.0 |
| Butyl cellosolve/EB (2-2-0) | 3.5 |
| Hydrogen Peroxide (35%) | 19.0 |

PRODUCT CHARACTERISTICS

| | |
|---|---|
| Specific gravity | 1.05 |
| PH (1%) | 5.3 |
| Color | clear, colorless |
| Appearance | Slightly viscous liquid |

These formulations were tested and found to be efficacious in commercial laundry applications and also had superior viscosity particularly at temperatures close to freezing. Thus, the present invention provides a means to add aqueous components to a hydrophobic surfactant formulation without causing gellation of the product. Thus, the present invention provides a wide variety of different formulations.

This has been a description of the present invention and the preferred mode of practicing the invention, however, the invention itself should only be defined by the appended claims wherein we claim:

1. A liquid detergent comprising a surfactant blend having an HLB of less than about 12 and from about 15% to about 77% by weight of an aqueous component in combination with an amount of N-methyl pyrrolidone effective to prevent gellation of the liquid detergent.

2. The composition claimed in claim 1 wherein said aqueous component comprises an aqueous solution of hydrogen peroxide.

3. The composition claimed in claim 1 wherein said N-methyl pyrrolidone is present in an amount of at least 1% by weight.

4. The composition claimed in claim 1 wherein said surfactant blend comprises a blend of surfactants selected from the group consisting of linear alcohol ethoxylates, alkyl benzene sulfonates, secondary alcohol ethoxylates, alkyl phenol ethoxylates and betaines.

5. The composition claimed in claim 4 wherein said surfactant blend comprises a blend of ethoxylated nonylphenols having an HLB of less than about 11.

6. The composition claimed in claim 1 comprising from about 20% to about 80% by weight surfactant blend from about 12% to about 77% by weight aqueous component and from about 1% to about 15% by weight N-methyl pyrrolidone.

7. The composition claimed in claim 5 further comprising from about 2% to about 6% by weight organic non-polar solvent.

8. The detergent composition claimed in claim 7 further comprising from about 3.8% ($C_1$–$C_8$)alkyl ether of alkylene ($C_2$–$C_3$)glycol.

9. A low temperature liquid detergent composition comprising a liquid surfactant system having HLB less than about 11, an aqueous component and an amount of N-methyl pyrrolidone effective to maintain said aqueous component in said surfactant blend without gellation; an organic solvent and a ($C_1$–$C_8$)alkyl ether of alkylene($C_2$–$C_3$)glycol.

10. The low temperature liquid detergent composition claimed in claim 9 wherein said aqueous component is an aqueous solution of hydrogen peroxide.

11. The low temperature liquid detergent claimed in claim 10 comprising 20% to 80% by weight liquid surfactant system consisting of nonionic surfactant, 1–15% by weight N-methyl pyrrolidone, 15% to 70% by weight aqueous solution of hydrogen peroxide and up to 6% by weight of said organic solvent.

12. A method of enhancing the stability of a detergent composition having a lipophyllic surfactant blend and an aqueous component comprising adding to said detergent composition N-methyl pyrrolidone in an amount effective to provide a stable non-gelled blend of said surfactant blend and said aqueous component.

* * * * *